United States Patent [19]

Barnhardt

[11] 3,999,662

[45] Dec. 28, 1976

[54] MERCHANDISE DISPLAY CASE

[76] Inventor: John M. Barnhardt, P.O. Box 125, Concord, N.C. 28025

[22] Filed: Aug. 21, 1975

[21] Appl. No.: 606,568

[52] U.S. Cl. ..... 211/133; 206/44 R; 206/45; 229/28 R; 248/174

[51] Int. Cl.[2] ..... A47F 3/14

[58] Field of Search ..... 211/133, 132, 72, 73; 248/152, 174; 206/44, 45, 45.14, 45.19; 229/28, 29

[56] References Cited

UNITED STATES PATENTS

| | | | |
|---|---|---|---|
| 1,448,138 | 3/1923 | List | 206/45 |
| 2,122,500 | 7/1938 | Sunderhauf | 248/152 X |
| 2,178,091 | 10/1939 | Weiss | 206/44 R |
| 2,312,594 | 3/1943 | Smith et al. | 211/72 |
| 2,518,779 | 8/1950 | Mennessey | 206/45 |
| 2,745,543 | 5/1956 | Broderick | 206/45 |
| 3,141,555 | 7/1964 | Funke et al. | 206/44 X |
| 3,164,350 | 1/1965 | Taub | 206/44 X |
| 3,308,934 | 3/1967 | Reiner | 206/45 |

FOREIGN PATENTS OR APPLICATIONS

| | | | |
|---|---|---|---|
| 1,282,708 | 12/1961 | France | 248/174 |

*Primary Examiner*—Roy D. Frazier
*Assistant Examiner*—Robert W. Gibson, Jr.
*Attorney, Agent, or Firm*—Bell, Seltzer, Park & Gibson

[57] ABSTRACT

A merchandise display case which is adapted to selectively support rows of merchandise in either a non-elevated shipment position or a display position wherein at least one of the rows is elevated to provide a highly visible, tiered arrangement. The rows are elevated by means of a pair of flaps in the bottom wall which may be pivoted and locked in an upright position without removing the merchandise from the case. The case may be positioned either directly on any supporting surface, or on a separate supporting stand having means for interlocking the case thereto to prevent the inadvertent movement of the case on the stand.

12 Claims, 11 Drawing Figures

MERCHANDISE DISPLAY CASE

The present invention relates to a merchandise display case and stand for displaying merchandise in a plurality of rows and characterized by the ability to selectively support at least one of the rows at either a non-elevated shipment position or an elevated display position.

In the merchandising of relatively small, packaged articles, such as hosiery, it is common to display the pachages in a tiered arrangement in a container which forms a part of the original shipment carton. For example, U.S. Pat. No. 3,164,350 to Taub illustrates a display stand comprising an upper container for the merchandise and a separate supporting base, and wherein the base includes upwardly protruding tabs which are received in corresponding slits in the container such that the tabs lift and support a movable false bottom when the container is placed on the base. Thus the rows of merchandise which are above the movable false bottom are elevated, while the other rows remain at a non-elevated position.

While the display stand of the type shown in the Taub patent achieves a desirable tiered arrangement of the rows when the container is used in conjunction with the specially designed base, the tiered arrangement cannot be achieved where the container is utilized alone. More particularly, space limitations in the store often require that the container be used apart from its stand, and in such cases the container must necessarily be placed directly on a counter top or other supporting surface. When supported in this manner, the tiered arrangement cannot be achieved, and the merchandising effectiveness of the display is substantially reduced.

It is accordingly an object of the present invention to provide a display case adapted to selectively support at least one of the rows of merchandise at either a non-elevated shipment position or an elevated display position to achieve a tiered arrangement of the rows, and wherein the elevating structure is entirely self-contained in the case. Thus the case of the present invention may be positioned on any supporting surface in a store, with the rows formed into a tiered arrangement.

It is another object of the present invention to provide a display case which is adapted to serve as a portion of a shipment carton for the merchandise, and with the merchanidise being in a non-elevated, compact form to minimize dead space, and wherein the case is adapted to be converted at the point of sale into an attractive, highly visible display comprising tiered rows of the merchandise.

It is another object of the present invention to provide a display case which includes a pair of flaps in the bottom wall thereof for elevating one or more rows of the merchandise, and wherein the flaps may be readily pivoted upwardly by the fingers of the sales clerk to effect the lifting of the selected rows without removing the merchandise therefrom. The flaps are further adapted to snap into a locked position with an audible sound, such that the proper positioning of the flaps is assured.

It is still another object of the present invention to provide a merchandise display case of the described type and supporting stand therefor, and wherein the case and stand may be interlocked to preclude the inadvertent separatin thereof.

These and other objects and advantages of the present invention are achieved in the embodiment illustrated herein by the provision of a display case which has a pair of pivotable, spaced-apart flaps formed in the walls thereof, with each flap being pivotable along a hinge line which is disposed at an acute angle with respect to the junction line formed between the wall containing the flap and an adjacent right angularly disposed wall. In addition, each flap includes a peripheral edge portion which is positioned adjacent the junction line so as to be progressively biased against the adjacent wall upon the flap being pivoted outwardly from its wall. A pair of slots are also formed in the walls of the case, with one of the slots being disposed adjacent each flap in the adjacent right angularly disposed wall for engagingly receiving the peripheral edge portion of the flap upon the flap being pivoted outwardly. By the above arrangement, a sales clerk or the like is able to lift at least one of the rows of merchandise by pivoting the flaps. When fully pivoted, the peripheral edge portion of each flap is engagingly received in the associated slot to thereby maintain the pivoted positioning of the flaps and such that the flaps will be locked in an upright position.

The elevating structure of the display case of the present invention is self-contained and thus the case may be positioned on any supporting counter or the like. Alternatively, the case may be used in association with a separate stand which is adapted to underlie the bottom wall of the case and thereby position the case above the floor. Means including a pair of upstanding panels may also be provided on the stand for interlocking the case to the stand to thereby preclude the inadvertent separation thereof.

Some of the objects and advantages of the invention having been stated, other objects and advantages will appear as the description proceeds, when taken in connection with the accompanying drawings, in which.

Figure 1:
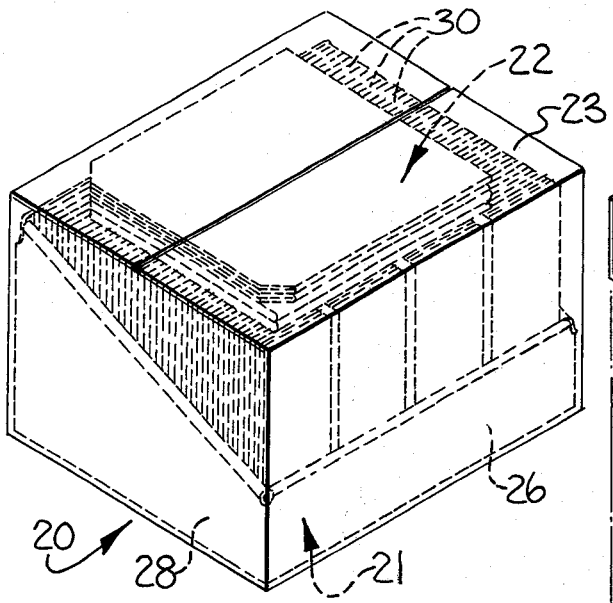
FIG. 1 is a perspective view of a shipment carton which includes a display case and stand embodying the features of the present invention.

Referring more specifically to the drawings, FIG. 1 illustrates a shipment carton 20 which incorporates a display case 21 and stand 22 embodying the features of the present invention. More particularly, the display case 21 forms the bottom or merchandise receiving section of the carton 20, and a conforming cover 23 is telescopically disposed over the case 21 to enclose the merchandise. Also, the stand 22 is positioned within the carton and on top of the merchandise, the stand being in a folded configuration as hereinafter further described.

The case 21, stand 22, and cover 23 may be fabricated from sheets of conventional corrugated paperboard material, with the sheets being suitably die cut and scored to permit the sheets to be folded into and held in the desired configuration. Since the fabrication of sheets of corrugated paperboard into the illustrated shapes is well known in the art (note for example the above Taub patent), a detailed description of such methods of fabrication will not be set forth herein.

Figure 5:
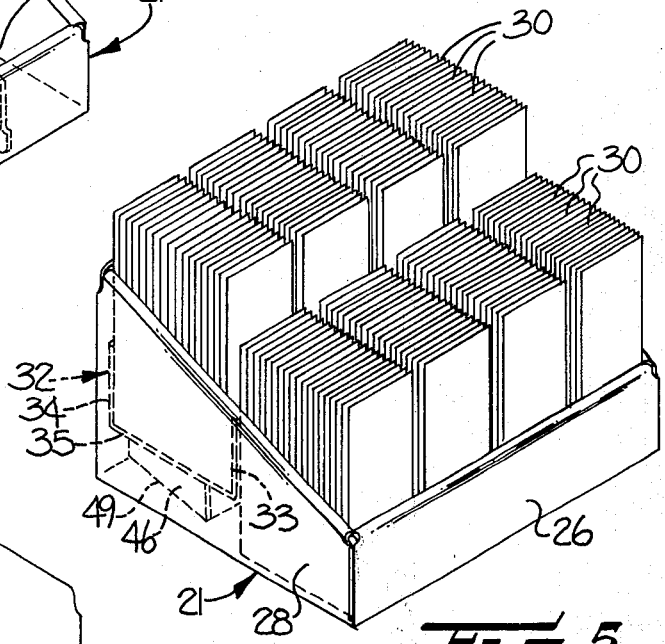
FIG. 5 is a view similar to FIG.. 4 and further illustrating the manner in which the rows of merchandise are disposed in a tiered arrangement when the case is in its elevated display configuration.

The display case 21 comprises a rectangular box-like receptacle having a bottom wall 25, a front wall 26, a rear wall 27, opposite side walls 28, 29, and an open top. As best seen in FIG. 5, the packages of merchandise are disposed in the case 21 in rows 30 which extend laterally from side to side, and the side walls 28, 29 are inclined from front to rear to increase the visibility of the merchandise while providing adequate support for the rear rows in the elevated position. Also, it will be noted that the front wall 26 and the side walls 28, 29 of the case 21 are formed by folding the paperboard sheet into a doubled thickness.

The case 21 further comprises a false bottom 32 which overlies the rear portion of the bottom wall 25 of the case, such that the false bottom 32 is adapted to directly support the rear rows of merchandise which are are to be lifted to effect the tiered arrangement. More particularly, the false bottom 32 may be formed from a sheet of corrugated paperboard material which is folded into a U-shaped cross-sectional configuration to define front and rear walls 33, 34, and a bottom wall 35 having a width sufficient to receive the desired number of rows of merchandise. In addition, the false bottom 32 includes three slots 36 which extend widthwise across the bottom wall 35 and upwardly along a portion of the height of each of the front and rear walls 33, 34.

Figure 2:
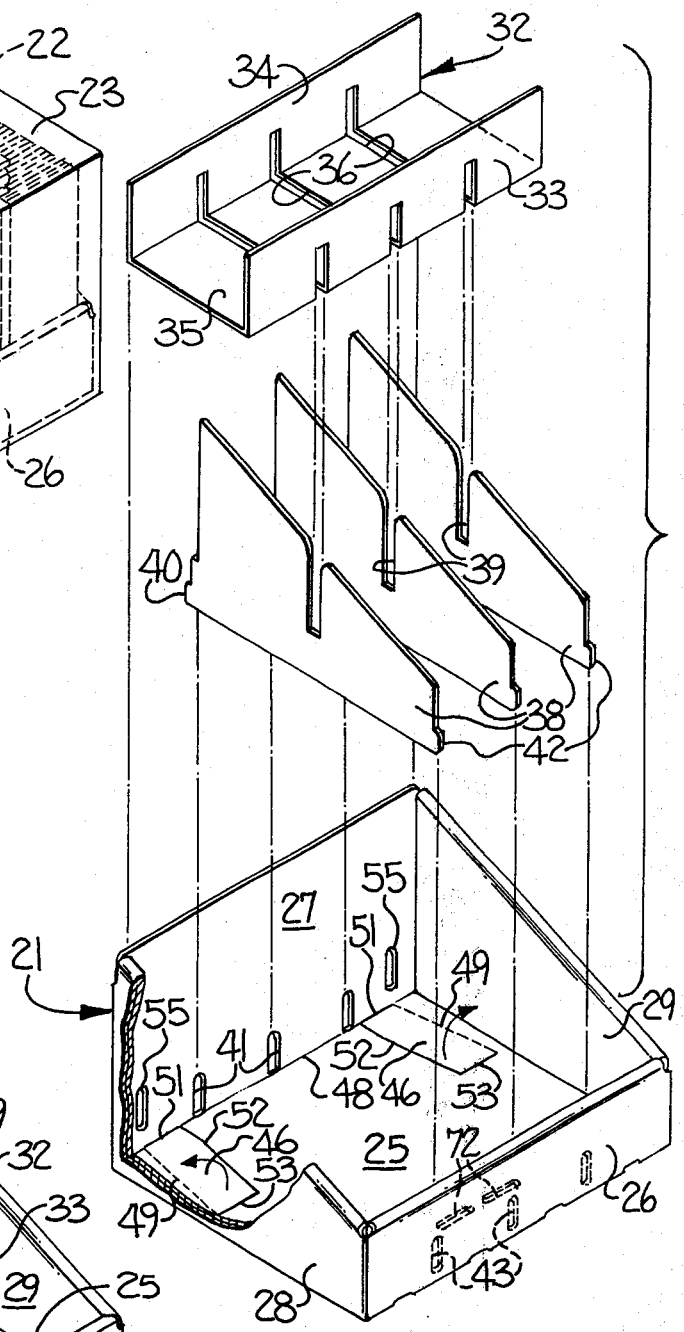
FIG. 2 is an exploded perspective view of the display case shown in FIG. 1.

Three partitions 38 are also included in the case 21, the partitions extending from front to rear and defining a gridwork for laterally supporting the packages of merchandise. Each partition 38 is tapered along the upper surface to conform to the taper of the side walls 28, 29. Also each partition includes front the rear sections separated by a vertical slot 39, a rearwardly directed tab 40 adapted to extend into a mating slot 41 in the rear wall 27 of the case, and a forwardly directed tab 42 adapted to enter a corresponding slot 43 in the front wall 26 of the case. By this arrangement, the false bottom 32 is adapted to be disposed over the partitions 38 in the manner apparent from FIGS. 2 and 3, and the false bottom is free to be lifted vertically while the partitions remain stationary. Also, it will be observed that the forward and rear walls 33, 34 of the false bottom 32 serve to support the rows of merchandise which are intended to be lifted in the manner hereinafter further described.

Figure 7:
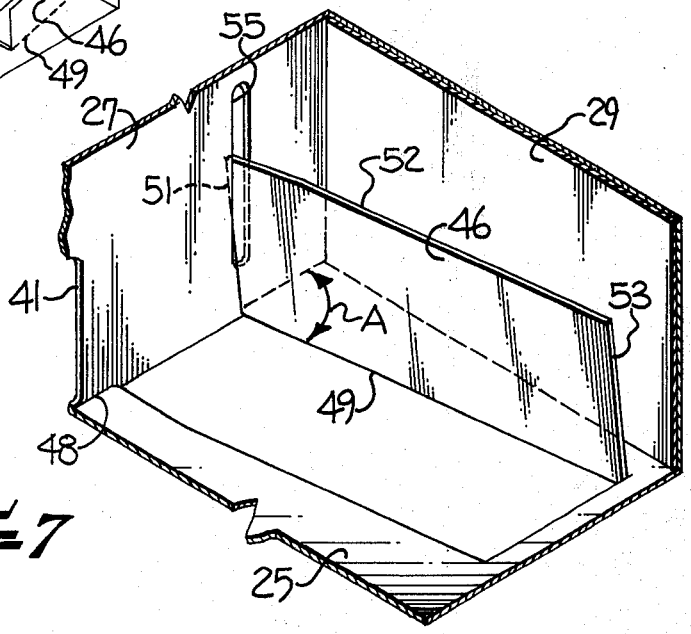
FIG. 7 is a fragmentary perspective view illustrating the flap and cooperating slot of the case, with the flaps being pivoted upwardly and engagingly received in the slot.

As seen in FIG. 1, the merchandise in the carton 20 is disposed in a plurality of laterally directed rows 30, with all of the rows being disposed at a substantially uniform, non-elevated position. This represents the configuration of the merchandise as initially packaged and shipped. In accordance with the present invention, means are provided for elevating the rear rows of merchandise into a tiered arrangement for enhancing the visibility thereof. The structure for elevating the merchandise is self-contained within the case, and comprises a pair of pivotable, spaced apart flaps 46 formed in the bottom wall 25 and adjacent the junction line 48 between the bottom wall 25 and rear wall 27. Each of the flaps 46 is connected to the bottom wall along a hinge line 49 which terminates adjacent the junction line 48 and which is disposed at an acute angle A (FIG. 7) with respect to the junction line as measured from the side of the hinge line opposite the flap.

Each of the flaps 46 further comprises three cut side edges 51, 52, 53 defining a straight sided parallelogram, with the cut edge 51 being disposed along the junction line 48 and a substantial portion of the cut edge 52 being disposed parallel to the hinge line 49 (a short segment of the edge 52 adjacent the line 48 being tapered to avoid communication with the slot 41). Thus the cut edge 51 defines a peripheral edge portion of the flap which, by reason of the inclination of the hinge line 49, is progressively biased against the rear wall 27 upon the flap 46 being pivoted upwardly from the bottom wall 25. Viewing FIG. 2, it will also be observed that the two flaps 46 are disposed adjacent the lower rear corners of the case 21, and each hinge line 49 is disposed on the side of the flap adjacent the adjacent side wall (28 or 29) of the case. This arrangement facilitates the manual pivoting of the flaps as hereinafter further described.

Figure 4:
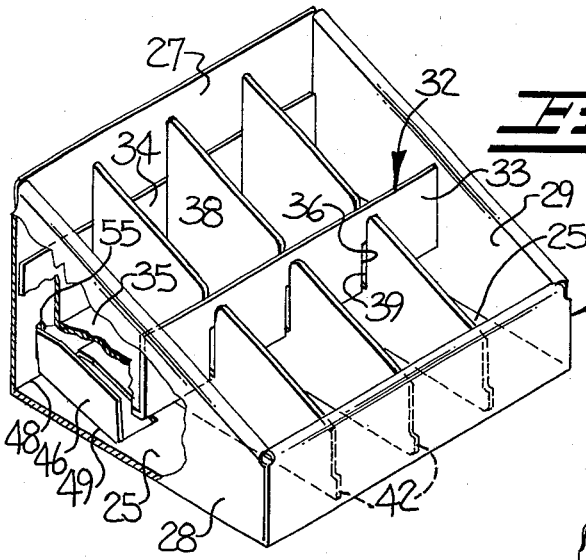
FIG. 4 is a perspective view similar to FIG. 3 but illustrating the case in its elevated display configuration.
Figure 6:
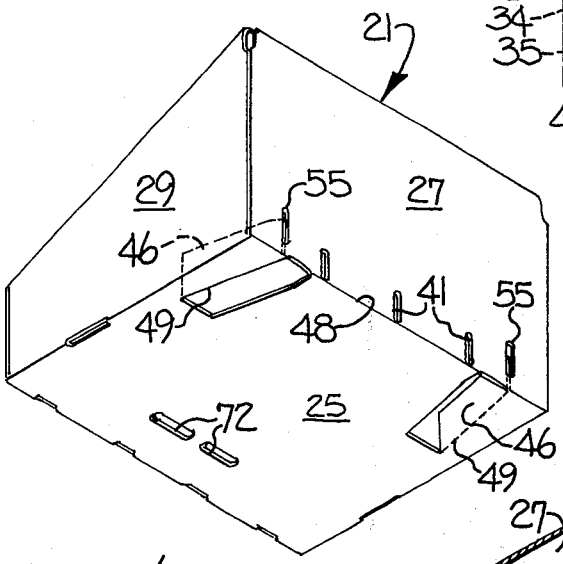
FIG. 6 is a perspective view of the case looking upwardly at the bottom wall thereof.

A pair of elongate, relatively thin slots 55 are disposed in the rear wall 27 of the case 21, with each of the slots 55 extending in a direction substantially perpendicular to the junction line. More particularly, each of the slots 55 is positioned above the terminal end of the hinge line 49 of one of the flaps 46, and is positioned to engagingly receive the cut side edge 51 upon the flap being pivoted into a substantially upright position, note FIG. 7. The slots 55 are slightly spaced from the junction line 48 to leave a rigidifying rib therebetween, and the slots 55 have a width and length sufficient to receive a substantial portion of the cut side edge 51. Thus when the flaps 46 are pivoted upwardly, the cut side edge 51 of each flap is progressively biased into the rear wall 27, and then it drops or snaps into the slot 55 with an audible sound so as to be engagingly received and locked therein. Concurrently, the flaps 46 lift and retain the false bottom 32 at the elevated position as shown in FIGS. 4–6. In this regard, the cut edge 52 remains parallel to the bottom wall 25 during the pivotal movement, and underlies substantially the full width of the false bottom 32 to thereby support the rear rows of merchandise at an elevated display position.

Figure 3:
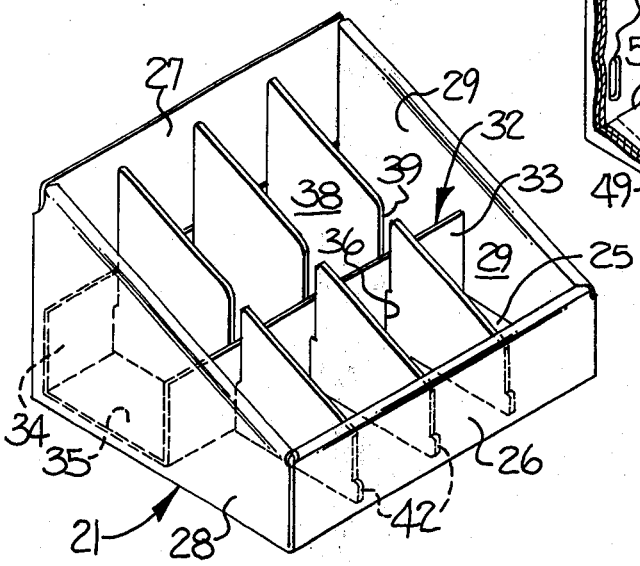
FIG. 3 is a perspective view of the display case in its non-elevated or shipment configuration.

From the above description, it will be apparent that the rear rows of merchandise may be lifted from the non-elevated position shown in FIGS. 1 and 3, to the elevated position shown in FIG. 5 by a sales clerk grasping the case 21 such that the fingers of each hand underlie one of the flaps 46 along the bottom wall 25. By squeezing upwardly on the flaps 46 with the fingers, the flaps may be pivoted to a position substantially perpendicular to the bottom wall 25 to lift the false bottom 32 and the rear rows of merchandise. By reason of the inclined orientation of the hinge line 49 of the flap, the cut side edge 51 will be progressively biased into the rear wall 27 of the case until the flap is fully upright, at which point the cut side edge 51 drops or snaps into the slot 55 with an audible sound. Thus the flaps 46 will be engagingly received in the slots 55 with the cut side edges 52 supporting the false bottom 32 and rear rows of merchandise. By this arrangement, the rear rows may be conveniently and quickly elevated by the clerk at the point of sale or display, without removing the merchandise from the case. Also, the audible sound permits the clerk to recognize when the fully pivoted and locked position is reached. Where the cut edge 51 is disposed directly along the junction line 48 as illustrated herein, an acute angle A of about 80° has been found to be effective in obtaining the desired biasing engagement between the cut edge 51 and rear wall 27.

While the illustrated embodiment of the case shows a single tier of elevated rows of merchandise, it will be appreciated that additional tiers may easily be provided. For example, the cut edges 52 of each of the flaps 46 could be correspondingly notched to define two horizontal supporting surfaces when in the pivoted position, and with the higher surface being disposed adjacent the rear wall 27 of the case and the lower surface being disposed along the medial portion of the case. A separate false bottom could then be positioned to overlie each of the pairs of elevated surfaces, with the rear false bottom extending between the higher surfaces of the flaps, and the forward false bottom extending between the lower surfaces of the flaps.

It will also be appreciated that the flaps 46 could be disposed in walls of the case other than the bottom wall 25 as shown in the illustrated embodiment. For example, one flap could be disposed in each of the side walls 28, 29 and adjacent the lower rear corner of the case, such that the cut side edge of each flap adjacent the junction line between the side wall containing the flap and the rear wall 27 is progressively biased into the rear wall 27 upon the pivoting of the flap. The slots 55 would be oriented horizontally in the rear wall 27 to engagingly receive this cut side edge of each flap, and the two flaps would then be disposed horizontally in the elevated configuration to thereby support the rear rows of merchandise above the level of the bottom wall 25. Alternatively, the slots 55 could be located such that the flaps in the side walls are pivoted through almost 180° prior to engaging the slots.

While the use of a false bottom 32 is preferable in the case of most types of packaged merchandise, in some instances the merchandise will extend fully across the case 21 in the lateral direction and is self supporting. In such instances, the merchandise may be supported directly by the flaps, and the false bottom may be eliminated.

Figure 8:
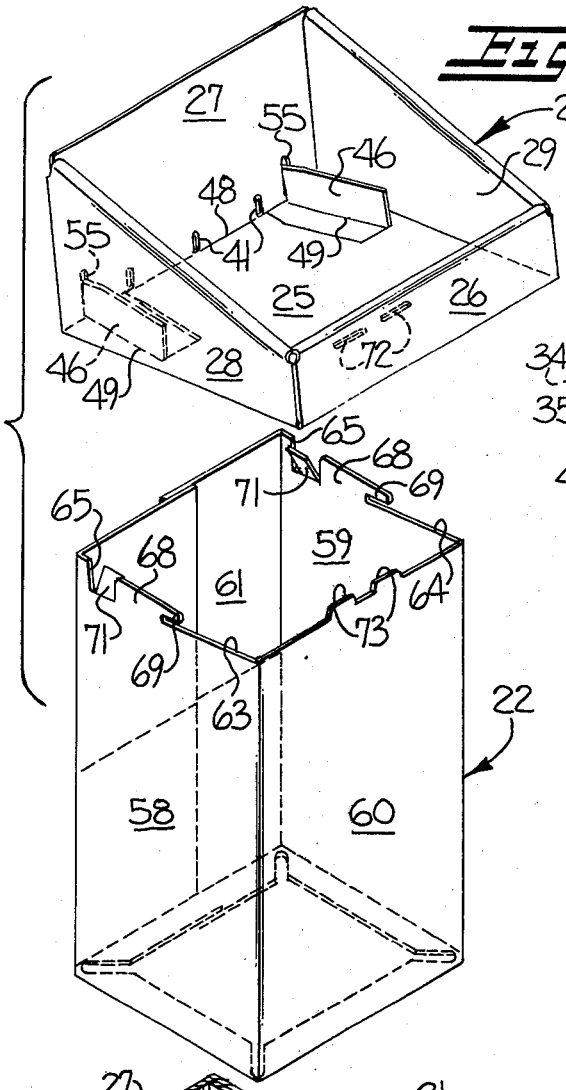
FIG. 8 is an exploded perspective view illustrating the display case and supporting stand of the present invention.

As noted above, a separate stand 22 may be shipped in the cartion 20 for supporting the case 21 at a desired elevation above the floor. The stand 22 comprises an open ended box having opposing side walls 58, 59, and front and rear walls 60, 61, respectively. Preferably, the stand 22 is adapted to be folded in a conventional manner into a flat arrangement as shown in FIG. 1 to minimize shipment volume. In its open or operative configuration as seen in FIGS. 8–9, the side walls 58, 59 of the stand define upper edge surfaces 63, 64, respectively, which are substantially co-planar, and which collectively define a substantially horizontal supporting surface for underlying the bottom wall 25 of the case 21 and thereby supporting the case 21 above the stand 22.

Figure 9:
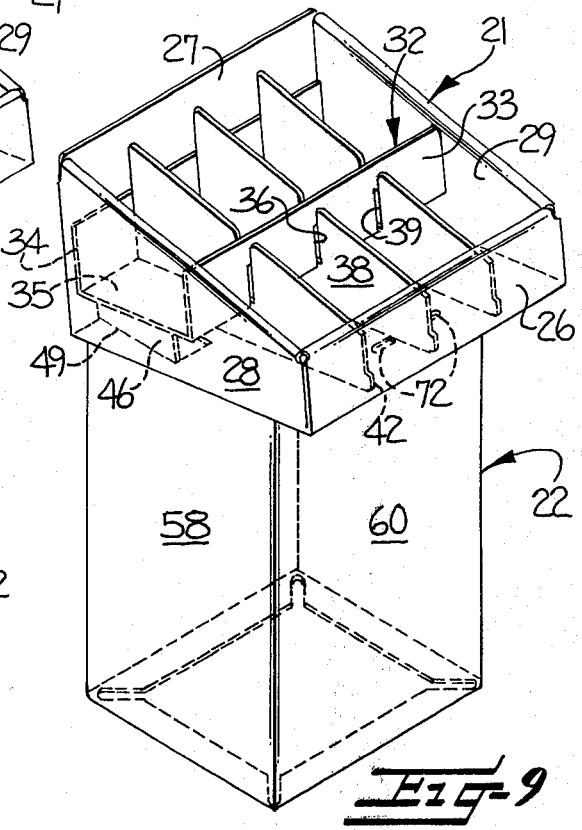
FIG. 9 is a perspective view illustrating the display case and stand in their assembled configuration.

In the illustrated embodiment, the upper edge surfaces 63, 64 of the side walls are slightly inclined downwardly from the front wall 60 toward the rearwall 61 such that the case bottom wall 25 is disposed at a corresponding inclination when supported on the stand, note FIG. 9. The inclined edge surfaces terminate at the vertical abutment 65 immediately in front of the rear wall 61. Thus the abutment 65 and rear wall 61 of the stand extend above the adjacent portion of the upper edge surfaces 63, 64 to thereby overlie the lower portion of the case rear wall 27 to preclude rearward movement of the case 21 on the stand 22.

Figure 10:
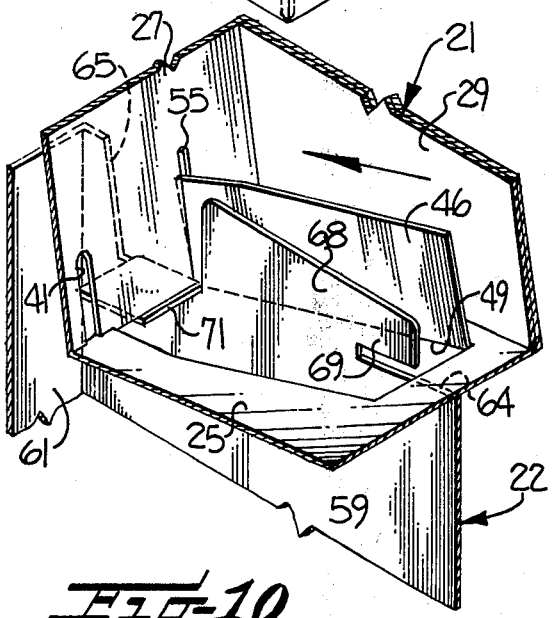
FIG. 10 is a fragmentary perspective view illustrating the position of the interlocking means during the initial step of the assembly of the case on the stand.
Figure 11:
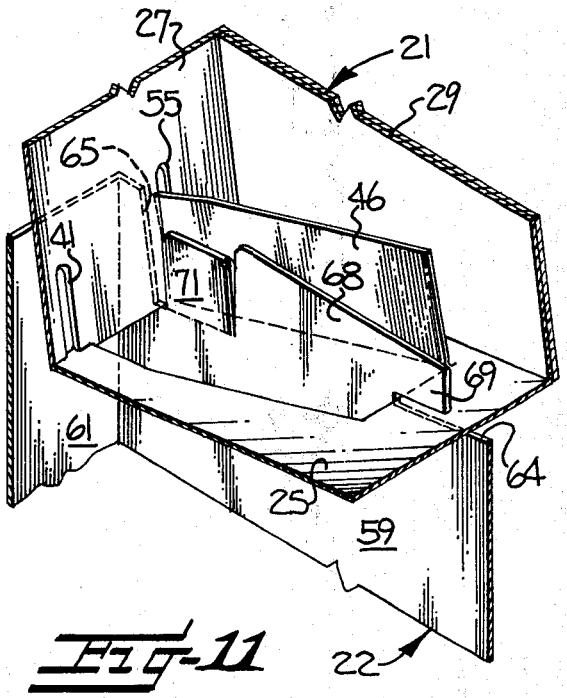
FIG. 11 is a view similar to FIG. 10 and illustrating the final configuration of the interlocking means between the case and stand.

As a further aspect of the present invention, means are provided for interlocking the case 21 to the stand 22 to preclude the inadvertent separation thereof. This interlocking means comprises the pair of spaced apart openings in the bottom wall 25 of the case as defined by the flaps 46 when pivoted to their raised or elevated positions, and a panel 68 extending upwardly from the upper edge surface of each of the side walls of the stand. More particularly, each panel 68 includes a forwardly directed tongue 69 spaced above the associated upper edge surface a distance sufficient to accommodate the thickness of the bottom wall 25 of the case therebetween. By design, the openings defined by the flaps 46 are spaced apart a distance substantially corresponding to the separation of the opposite side walls 58, 59 of the stand, such that the case 21 may be interconnected to the stand 22 by lowering the case onto the stand such that each of the panels 68 enters one of the openings (FIG. 10), and then sliding the case rearwardly such that the tongues 69 overlie the portions of the bottom wall 25 of the case adjacent the edges of the openings (FIG. 11). In this regard, it will be noted that the panels 68 have a vertical height less than the vertical height of the flaps 46 in their pivoted position, such that the panels do not contact the false bottom 32.

The stand further comprises a pivotable locking tab 71 extending upwardly from each of the upper edge surfaces 63, 64 of the stand and positioned intermediate the associated panel 68 and abutment 65. In addition, the tab 71 is spaced from the abutment 65 a distance sufficient to accommodate the thickness of the case rear wall 27 therebetween. The locking tab 71 may be suitably scored along a line parallel to the associated upper edge surface 63, 64 to permit the tab 71 to readily pivot laterally during positioning of the case upon the stand. More particularly, when the case 21 is initially positioned on the stand 22 prior to sliding the same rearwardly, the rear wall 27 of the case causes the tabs 71 to pivot laterally, note FIG. 10. When the case is slid rearwardly to effect the interlocking engagement with the tongue 69, the rear wall 27 of the case engages the abutment 65 of the stand to permit the locking tab 71 to return, by its own resilience, to its original upright position. Thus the locking tab precludes forward movement of the case 21 on the stand 22 which otherwise result in a release of the interlocking engagement.

To further preclude inadvertent forward movement of the case on the stand, there is provided a pair of slots 72 in the bottom wall 25 of the case adjacent the front side wall 26 thereof, not FIG. 6. Also, the upper edge of the front wall 60 of the stand 22 includes a pair of upwardly extending tabs 73 which are adapted to be received in the slots 72 when the case is positioned fully rearwardly on the stand.

In the drawings and specification, there has been set forth a preferred embodiment of the invention, and although specific terms are employed, they are used in a generic and descriptive sense only and not for purposes of limitation.

That which is claimed is:

1. A merchandise display case for displaying merchandise in a plurality of rows and characterized by the ability to selectively support at least one of the rows at either a non-elevated shipment position or an elevated display position, said display case comprising a rectangular receptacle having a front wall, a rear wall, opposite side walls, a bottom wall, and an open top, a pair of pivotable, spaced apart flaps formed in said bottom wall and adjacent the junction line between said bottom wall and said rear wall, each of said flaps being connected to said bottom wall along a hinge line which terminates adjacent said junction line and which is disposed at an acute angle with respect to said junction line as measured from the side of said hinge line opposite the flap, and with a peripheral edge portion of each flap being positioned adjacent said junction line so as to be biased against said rear wall upon the flap being pivoted upwardly from said bottom wall, and a pair of slots disposed in said rear wall, each of said slots being respectively disposed above the adjacent terminal ends of the hinge lines so that upward pivoting of said flaps causes said peripheral edge portion of each flap to be biased along the rear wall and into engaging reception in the associated slot to maintain the pivoted positioning of the flaps and thereby support at least one of the rows of merchandise at an elevated display position.

2. The merchandise display case as defined in claim 1 wherein each of said flaps is disposed entirely in said bottom wall and adjacent one of the lower rear corners of the receptacle with each hinge line being disposed on the side of the flap adjacent the adjacent side wall of the receptacle.

3. The merchandise display case as defined in claim 2 wherein said case further comprises a false bottom overlying the rear portion of said bottom wall and both of said flaps, such that the false bottom is adapted to directly support those rows of merchandise which are elevated by the pivoting of said flaps.

4. The merchandise display case as defined in claim 3 wherein each of said flaps has a peripheral edge portion opposite and parallel to the hinge line for engagingly supporting the lower surface of said false bottom.

5. The merchandise display case as defined in claim 4 wherein said side walls of said receptacle are inclined upwardly from front to rear so that said rear wall is adapted to support the elevated rows of merchandise while the lower front wall contributes to the visibility of the merchandise.

6. The merchandise display case as defined in claim 5 wherein said case further comprises a plurality of partitions carried therein and defining a supporting gridwork for the merchandise.

7. A merchandise display apparatus for displaying merchandise in a plurality of rows and characterized by the ability to selectively support at least one of the rows at either a non-elevated shipment position or an elevated display position, said display apparatus comprising a rectangular display case having a front wall, a rear wall, opposite side walls, a bottom wall, and an open top, a pair of pivotable, spaced apart flaps formed in said bottom wall and adjacent the junction line between said bottom wall and said rear wall, each of said flaps being connected to said bottom wall along a hinge line which terminates adjacent said junction line and which is disposed at an acute angle with respect to said junction line as measured from the side of said hinge line opposite the flap, and with a peripheral edge portion of each flap being positioned adjacent said junction line so as to be biased against said rear wall upon the flap being pivoted upwardly from said bottom wall, a pair of slots disposed in said rear wall, each of said slots being respectively disposed above the adjacent terminal ends of the hinge lines so that upward pivoting of said flaps causes said peripheral edge portion of each flap to be biased along the rear wall and into engaging reception in the associated slot to maintain the pivoted positioning of the flaps and thereby support at least one of the rows of merchandise at an elevated display position, a stand for supporting said case at an elevated location above a floor, said stand comprising side walls having upper edge surfaces which are adapted to underlie said bottom wall of the case and thereby support the case above the stand, and means integrally formed with the stand for interlocking said case to said stand to preclude the inadvertent separation thereof.

8. The merchandise display apparatus as defined in claim 7 wherein said side walls of said stand are disposed in opposing, parallel relationship to each other and are spaced apart a distance substantially corresponding to the spacing of said flaps in said bottom wall of said case, and said means for interlocking said case to said stand comprises a panel extending upwardly from said upper edge surface of each of said opposing side walls of said stand, each panel including a forwardly directed tongue spaced above the associated upper edge surface a distance sufficient to accommodate the thickness of said bottom wall of said case therein, whereby the case may be interconnected to the stand by lowering the case onto the stand such that each of the panels enters one of the openings in the bottom wall defined by the pivoted flaps, and then sliding the case rearwardly such that the tongues overlie the portions of the bottom wall of said case adjacent the edges of the openings.

9. The merchandise display apparatus as defined in claim 8 wherein said pivotable flaps each have an outline defining a parallelogram and such that the peripheral edge portion thereof opposite said hinge line is disposed parallel to and spaced above said bottom wall when said flaps are in their pivoted position, and wherein each of said panels on said stand has a vertical height less than such vertical spacing of said flaps above said bottom wall.

10. The merchandise display apparatus as defined in claim 9 wherein said stand further comprises a rear wall which extends upwardly above the adjacent portions of the upper edge surfaces of said opposing side walls of said stand, and said stand further comprises a pivotable locking tab extending upwardly from each of said upper edge surfaces of said stand and positioned intermediate the associated panel and stand rear wall, each of said tabs being spaced from said stand rear wall a distance sufficient to accommodate the thickness of said case rear wall therebetween and being adapted to pivot laterally during positioning of said case upon said stand and then return to its upward position forwardly of said case rear wall when the case assumes its interconnected position to thereby preclude inadvertent forward movement of the case on the stand.

11. The merchandise display apparatus as defined in claim 10 wherein said stand further comprises a front wall including at least one tab extending upwardly therefrom, and said bottom wall of said case includes a slot adapted to receive said front wall tab when the case is in its interconnected position to thereby further preclude inadvertent forward movement of the case on the stand.

12. The merchandise display apparatus as defined in claim 11 wherein said upper edge surfaces of said stand opposing side walls are inclined downwardly from said stand front wall toward said stand rear wall such that said case bottom wall is disposed at a corresponding inclination when supported on said stand, and with a portion of said stand rear wall overlying the lower portion of said case rear wall to preclude rearward movement of the case on the stand.

* * * * *